United States Patent [19]

Koppers et al.

[11] 4,236,850

[45] Dec. 2, 1980

[54] SHIELD TIMBERING FRAME FOR TIMBERING MINES

[75] Inventors: Manfred Koppers; Ludwig Pawelski, both of Duisburg, Fed. Rep. of Germany

[73] Assignee: Thyssen Industrie AG, Fed. Rep. of Germany

[21] Appl. No.: 971,334

[22] Filed: Dec. 20, 1978

[30] Foreign Application Priority Data

Dec. 24, 1977 [DE] Fed. Rep. of Germany ..... 2757885

[51] Int. Cl.[3] ..... E21D 15/44

[52] U.S. Cl. ..... 405/291; 405/295

[58] Field of Search ..... 405/291–296, 405/302; 299/31, 33; 91/170 MP

[56] References Cited

U.S. PATENT DOCUMENTS

| | | | |
|---|---|---|---|
| 3,127,748 | 4/1964 | Cooke | 405/293 |
| 3,902,325 | 9/1975 | Sigott et al. | 405/296 |
| 4,048,804 | 9/1977 | Elsner et al. | 405/295 |
| 4,121,426 | 10/1978 | Heyer | 405/296 |

FOREIGN PATENT DOCUMENTS

| | | | |
|---|---|---|---|
| 2151428 | 4/1973 | Fed. Rep. of Germany | 405/292 |
| 1175285 | 3/1959 | France | 405/291 |

*Primary Examiner*—Dennis L. Taylor

*Attorney, Agent, or Firm*—McGlew and Tuttle

[57] ABSTRACT

A shield timbering frame for timbering mines adjacent a mining face, comprises a horizontal floor-engaging skid and a breaking shield extending obliquely over the skid which is connected to the skid by a pair of longitudinally spaced, lemniscate guide rods. A roof cap member has an inner end which is pivoted to the upper end of the breaking shield and it is also braced by a piston and cylinder combination which is articulated to the breaking shield intermediate the length thereof and to the roof cap intermediate its length. At least one hydraulic ram is mounted on the skid and is engaged with the roof cap between the connection of the roof cap to the breaking shield and the connection to the additional support. The hydraulic ram is madeup of at least three telescopically interengageable extensible and retractable parts and includes pressure valve means to provide a substantially equal support pressure on the roof cap in various positional orientations of the roof cap.

7 Claims, 3 Drawing Figures

SHIELD TIMBERING FRAME FOR TIMBERING MINES

FIELD AND BACKGROUND OF THE INVENTION

This invention relates to mining apparatus in general and, in particular, to a new and useful shield timbering frame for timbering mines, which includes a horizontal floor-engaging skid, a breaking shield which is mounted over guide rods at the backfilling end of the horizontal skid, and a roof cap articulated at the free end of the breaking shield which is supported by at least one hydraulic ram resting in the horizontal skid.

DESCRIPTION OF THE PRIOR ART

Shield timbering frames, as well as other mine timbering devices should have many uses, if possible, so that they can be used with equally good results in longwalls of different thicknesses. In order to meet this requirement, it is necessary to design shield timbering frames in a manner such that they have a relatively wide range of adjustment. Particularly serious problems in the constructional design of the shield timbering frame are encountered when an overall retracted height of 600 mm or less is required. Since the minimum overall height of a timbering frame depends to a great extent on the length of the supporting ram in the retracted state, the latter has a corresponding inclination at the lower levels in the known constructions. However, a variation of the inclination of the supporting ram at the various levels of a timbering frame has the disadvantage that it necessarily results in different supporting capacities, because a variation of the blade angle also results in a variation of the force component acting in the longitudinal direction of the ram. If a pressure-keeping valve, set for a certain supporting capacity, is used for the pressure medium chamber of the ram, this will result in different bearing pressures.

Another unfavorable factor is that, with increasing inclination of the supporting ram, there is a risk that rock fragments will be jammed and the ram will be additionally stressed for bending and may be impaired or even blocked in its movement. In addition, an inclined ram results in an undesired narrowing of the roadway between the ram and the conveyor.

In order to increase the range of adjustment of the timbering frame, it is also known to use a double telescopic ram as a supporting ram, which has a lower overall height in the retracted state, compared to a simple ram and thus offers the possibility of meeting the requirement of a relatively low overall height of the timbering frame with a lesser inclination of the supporting ram. No satisfactory results have thus far been achieved in this respect either. Aggravating the situation are the substantially higher pressures which appear due to the reduction of the effective inner cross-section in the pressure chambers of the telescopic cylinders, whose control requires special measures. Furthermore, the requirement for a constant supporting capacity at all levels of the ram must be kept in mind, which likewise raises serious problems in a multiple telescopic ram.

SUMMARY OF THE INVENTION

The present invention provides an improved shield timbering frame constructed in a manner such that the disadvantages of the known models are overcome. The inventive shield timbering frame has an extremely wide range of adjustment and a substantially constant supporting capacity at all levels.

According to the invention, the shield timbering frame has two lemniscate guide rods for the articulated connection of the breaking shield with the horizontal skid. A hydraulic ram for the frame is designed as a multiple, at least triple, telescopic ram with a constant bearing pressure and is arranged vertically between the horizontal skid and the roof cap. A triple telescopic ram is preferably provided as a hydraulic ram.

A main advantage of the invention is that an ascending or descending timbering force by the supporting ram extending perpendicularly to the roof cap and horizontal skid is avoided in all operating positions of the timbering frame. Due to the fact that the supporting ram is designed as at least a triple telescopic ram with a constant bearing pressure, a relatively wide range of adjustment is obtained, which is an important prerequisite for the desired universal applicability of the shield timbering frame.

According to another feature of the invention, a piston cylinder arrangement (supporting cylinder) is provided for the additional reinforcement of the roof cap from the breaking shield between these two elements. The reinforcement acts on the roof cap adjacent the coal face end before the telescopic ram begins to act. This supporting cylinder offers the possibility of moving the application of the force of the telescopic ram on the roof cap further in the direction of its joint with the breaking shield, without impairing the desired division ratio of 2:1 of the front section to the rear section of the cap. This measure thus leads to a further increase of the roadway which is already less narrowed with the use of a vertical supporting ram than with a supporting ram inclined in the direction of a roadway.

A uniform supporting capacity is ensured in the telescopic ram according to the invention in all telescopic lengths by a nonreturn valve arranged in the bottom of the first moving telescopic cylinder (seen from the bottom) which is controlled by the sinking movement of the moving telescopic cylinder.

Accordingly, it is an object of the invention to provide a shield timbering frame for timbering mines adjacent a mining face, which comprises, a horizontal floor-engaging skid with a breaking shield extending obliquely over the skid, having a lower end and an opposite upper end and with a pair of lemniscate guide rods having their one ends connected to the breaking shield at longitudinally spaced locations adjacent the lower end of the breaking shield, and having opposite ends connected to the skid at longitudinally spaced locations adjacent the inner end thereof, and further including a roof cap member having an inner end pivoted to the upper end of the breaking shield, and having an opposite outer end adapted to extend toward the mining face, at least one hydraulic ram being engaged on said skid and pivotally connected to the roof cap at a spaced location from the roof cap connection to the breaking shield and being madeup of at least three telescopically interengageable extensible and rectractable parts and pressure valve means associated with the ram to provide a substantially equal support pressure during the various positions of the roof cap.

A further object of the invention is to provide a shield timbering frame which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
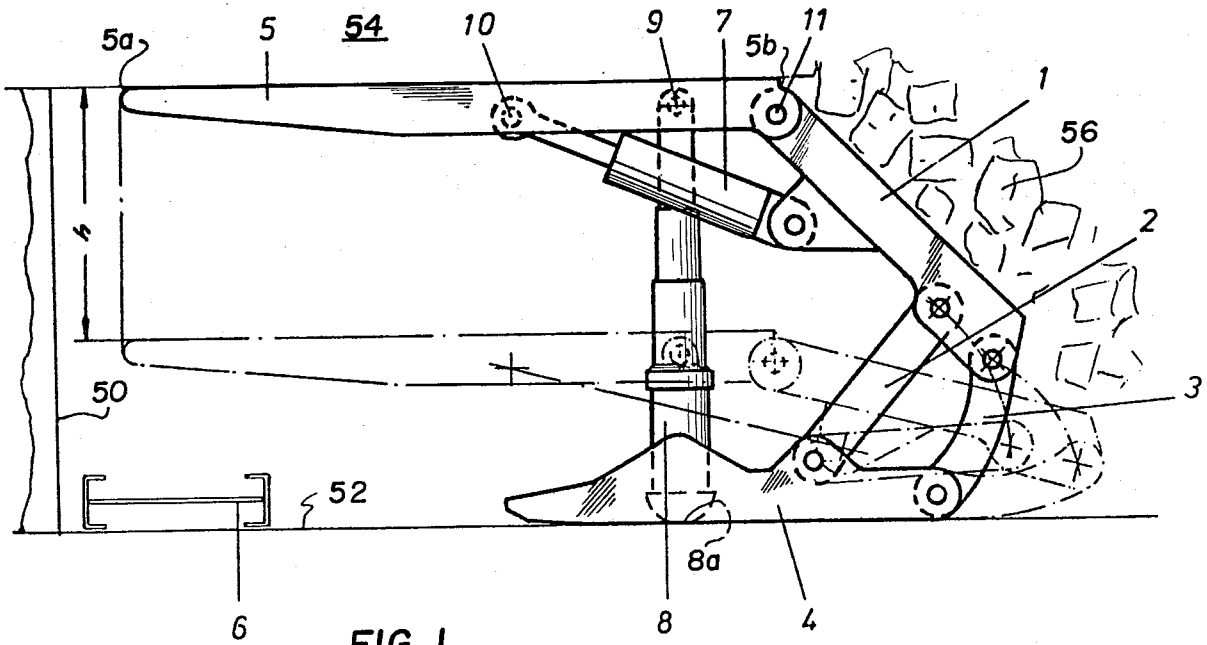
FIG. 1 is a schematic side elevational view of a shield timbering frame, constructed in accordance with the invention.

Referring to the drawings in particular, the invention embodied therein, comprises, a timbering frame for timbering mines adjacent a mine face 50, which comprises a horizontally arranged floor-engaging skid 4 which rests on a floor 52 of the mine and has a roof cap which is positionable on the excavated roof 54 of the mine and a breaking shield 1 which is disposed obliquely to hold back the rock face 56.

In the embodiment shown, breaking shield 1 is jointed over two lemniscate guide rods 2 and 3 with a horizontal skid 4. Rigid roof cap 5 which projects substantially beyond the tip of horizontal skid 4 to secure the roof cap 5 in the range above a conveyor 6 is articulated at the free or coal-free end of the breaking shield 1.

Roof cap 5 and breaking shield 1 are connected with each other by a piston-cylinder arrangement 7, which is also referred to as a supporting cylinder, which results in an additional reinforcement of roof cap 5 on breaking shield 1. For the support of roof cap 5, a triple telescopic ram 8 is provided, which is mounted vertically in horizontal skid 4 in a suitable manner, for example, by means of a ball and socket joint 8*a*, and which acts on roof cap 5 at its upper end. The point of application or pivot 9 is between the point of application 10 of piston-cylinder arrangement 7 and joint 11 of roof cap 5 with breaking shield 1.

In this embodiment, and in order to determine the division ratio, it is necessary to take into consideration not the point of application 9, but the resulting intensity of force which results from the forces of ram 8 and of piston-cylinder arrangement 7 and which is between the points of application 9 and 10. The desired division ratio of 2:1 of the front section, measured from the resulting point of application between the points 9 and 10 to the end of the cap 5*a* in respect to the rear section, measured from the resulting point of application to the opposite end 5*b* of the cap, can be maintained in this design without difficulties.

FIG. 1 also shows the attainable minimum overall height of the shield timbering frame in dot-dashed lines. As can be seen from the drawing, this minimum overall height is only slightly greater than the minimum height of the triple telescopic ram 8 in the fully retracted state.

Figure 2:
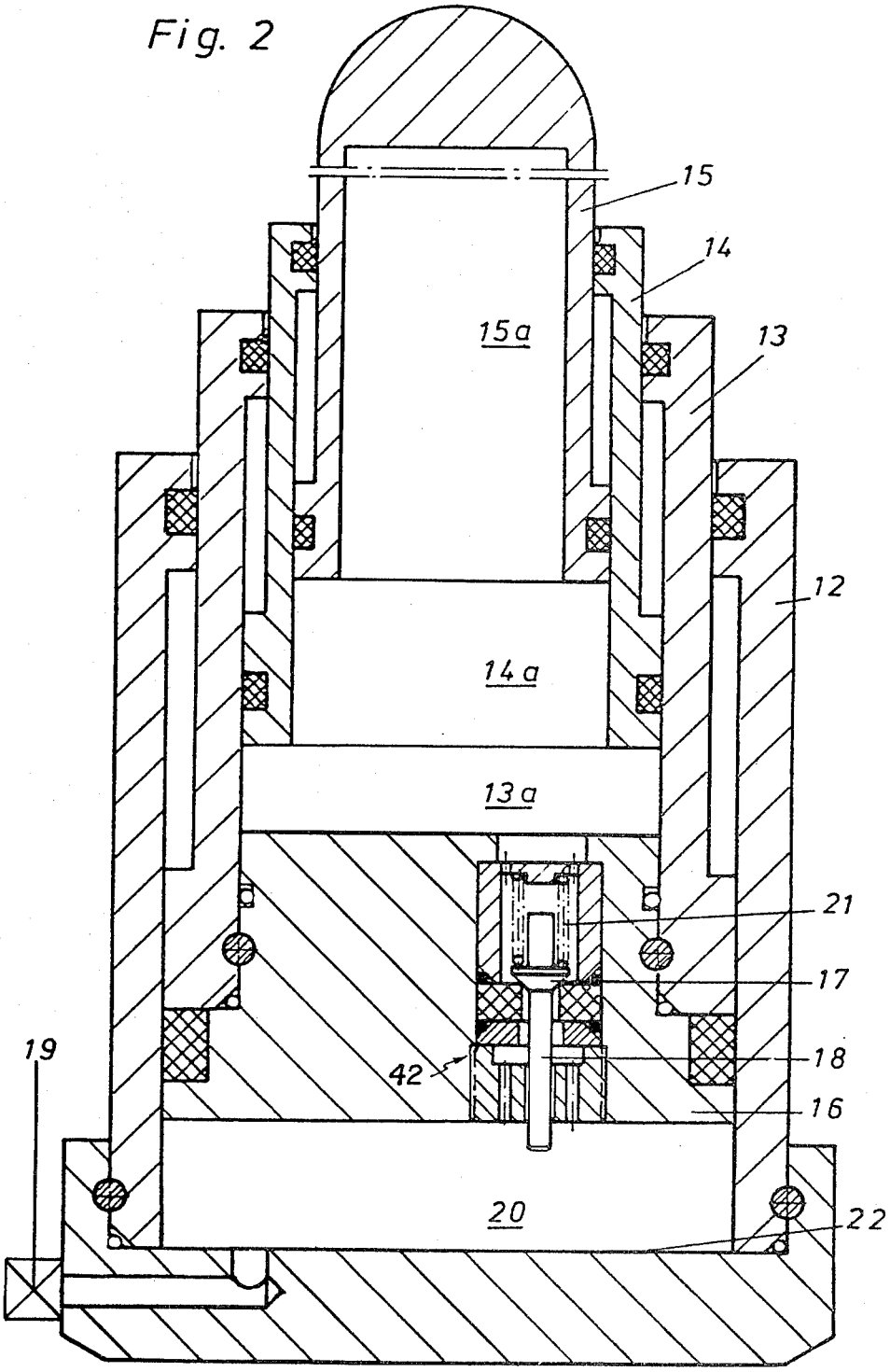
FIG. 2 is an enlarged sectional view of the telescopic ram shown in the apparatus of FIG. 1.

The design of the triple telescopic ram 8 can be seen from FIG. 2. It contains a lower non-moving cylinder 12 and three extensible telescopic cylinders 13, 14 and 15. The first extensible telescopic cylinder 13 is closed by a bottom plate 16 with pressure valve means including an inlet connection with an inlet pressure-keeping valve 19 and a nonreturn valve 42 having a spring-loaded valve body 17 arranged in a bore of this bottom plate 16. A plunger rod 18 is connected with valve body 17 which protrudes downwardly and projects slightly relative to bottom plate 16.

The mode of operation of the triple telescopic ram is as follows:

The pressure fluid introduced into the ram flows through the open inlet- and pressure-keeping valve 19 in the lower pressure medium chamber 20 and, from there, through the also open non-return valve 42 into the upper pressure medium chambers 13*a*, 14*a* and 15*a*. After filling, valve body 17 of the non-return valve 42 assumes the closing position, due to the action of return spring 21.

Assuming that the ram is extended to a maximum length and is loaded in an axial direction, the nonreturn valve 42 is closed, and the amount of pressure fluid in pressure medium chambers 13*a*, 14*a* and 15*a* thus cannot vary. When the minimum pressure of response of the inlet- and pressure-keeping valve 19 is exceeded with rising stress on the ram, pressure fluid flows off from pressure medium chamber 20, which results in joint sinking of the telescopic cylinders 13, 14 and 15. This means that the supporting capacity of the ram is determined by the minimum pressure of response of the inlet- and pressure-keeping valve 19.

When the jointly sinking telescopic cylinders 13, 14 and 15 have dropped so far that plunger rod 18 strikes on bottom 22, valve body 17 is lifted from its seat and pressure fluid can flow off from pressure-medium chambers 13*a*, 14*a* and 15*a*. This results in a pressure drop in the upper pressure medium chambers and in an immediate pressure rise in pressure medium chamber 20, which cause a slight rise of telescopic cylinder 13 which, in turn, has the effect that valve body 17 immediately assumes the closing position again. Even during the action of the pressure relief valve, the supporting capacity of the inlet- and pressure-keeping valve 19 depends solely on the minimum pressure of response of the inlet- and pressure-keeping valve 19. If the relatively small jumps caused by the brief "breathing" of the nonreturn valve are disregarded, a total load curve is obtained in the triple telescopic ram which is practically a horizontal line in a load-sinking path diagram.

Figure 3:
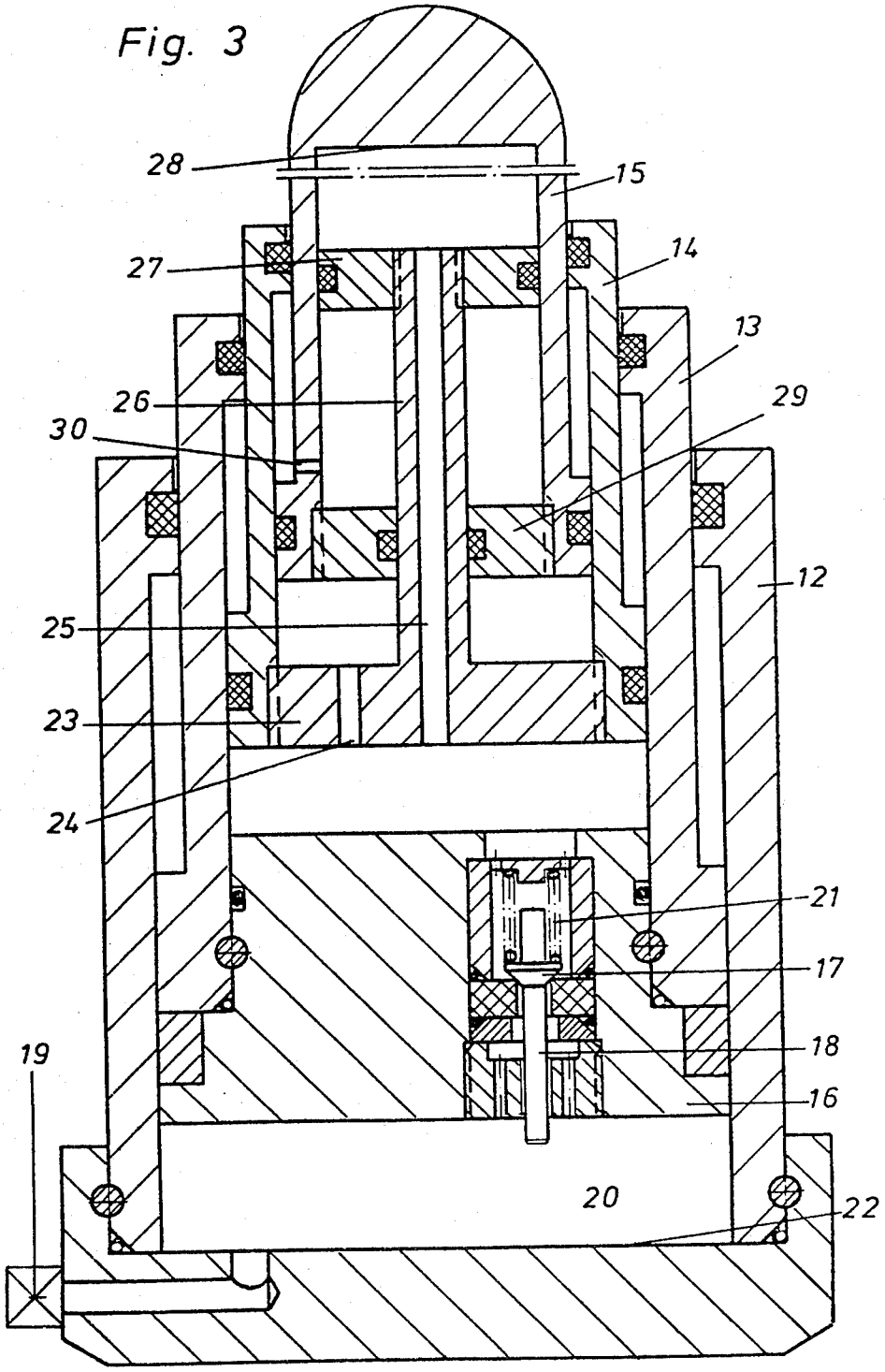
FIG. 3 is a view similar to FIG. 2 of another embodiment of the invention.

The triple telescopic ram of FIG. 3 corresponds in its basic design to the embodiment according to FIG. 2. Consequently, the same reference number as in FIG. 2 have been used for the identical parts in the Figure.

The difference in this embodiment is only that telescopic cylinder 14 is closed by a bottom plate 23, which contains a bore 24 in the edge zone and bore 25 in the center. On the top side, a supporting pipe 26 is secured on bottom plate 23 concentric to bore 25, which carries a piston 27 at its upper end guided in telescopic cylinder 15 which is screwed with a central threaded bore on an end thread of supporting pipe 26. When telescopic cylinder 15 is fully retracted, piston 27 is close to the inner end wall 28 of the latter. Furthermore, telescopic cylinder 13 is closed by a bottom plate 29, which has a central bore in which supporting pipe 26 is guided pressure-tight. The space between piston 27 and bottom plate 29 is connected with the atmosphere through a bore 30 in the cylinder wall.

Due to the additional parts described above, the space available in telescopic cylinders 13, 14 and 15 for the pressure medium is considerably reduced, compared to the embodiment according to FIG. 2, but less pressure fluid is required in this embodiment to start the three telescopic cylinders. Inversely, less pressure fluid has to be drained off during the sinking. This embodiment thus has the advantage that the ram can be filled faster and has a lower supporting capacity during sinking and yielding, respectively. The internal pressure above nonreturn valve 17 is reduced with the ram fully extended, because the supporting surface of telescopic cylinder 15 is increased by means of supporting pipe 26, bottom plate 29 and piston 27.

While specific embodiments of the invention have been shown and described in detail to illustrate the application of the principles of the invention, it will be understood that the invention may be embodied otherwise without departing from such principles.

What is claimed is:

1. A shield timbering frame for timbering mines adapted to be located adjacent a mining face, comprising, a horizontal floor-engaging skid, a breaking shield extending obliquely over said skid and having a lower end and an opposite upper end, a pair of lemniscate guide rods having their one ends connected to said breaking shield at longitudinally spaced locations adjacent said lower end of said breaking shield and having an opposite end connected to said skid at longitudinally spaced locations adjacent the inner end of said skid, a roof cap member having an inner end pivoted to the upper end of said breaking shield and having an opposite outer end adapted to extend toward the mining face, at least one hydraulic ram engaged on said skid and pivotally connected to said roof cap at a spaced location from said inner end which is pivoted to said upper end of said breaking shield, said ram being made up of at least three telescopically interengaged, extensible and retractable parts, said ram extending perpendicularly from said skid, and pressure valve means associated with said ram to provide a substantially equal support pressure by said ram on said roof cap in an uppermost position and in a plurality of positions below said uppermost position, said ram extending perpendicularly from said skid in all positions of said roof cap.

2. A shield timbering frame, as claimed in claim 1, including a piston-cylinder combination connected between said breaking shield and said roof cap, said piston and cylinder combination being pivoted on said roof cap at a location toward said opposite outer end of said roof cap and the connection between said roof cap and said ram and said piston cylinder combination being pivoted to said breaking shield.

3. A shield timbering frame, as claimed in claim 2, wherein said ram and said piston-cylinder combination exert a force on said roof cap at a resulting point which divides said roof cap into a front portion between said resulting point and said opposite outer end of said roof cap and a rear portion between said resulting point and said inner end of said roof cap, the ratio of length between said front and rear portions being the ratio of about 2:1.

4. A shield timbering frame, as claimed in claim 1, wherein the length of said roof cap between said roof cap connection with said ram and said opposite outer end thereof to the length of said roof cap between said pivotal connection thereof with said ram and said inner end is about 2:1.

5. A shield timbering frame, as claimed in claim 1, wherein sad hydraulic ram comprises a triple telescopic ram.

6. A shield timbering frame, as claimed in claim 1, wherein said pressure valve means includes a pressure medium inlet line connected to said hydraulic ram in a pressure space defined in said ram below said telescopically extensible and retractable parts, an inlet and pressure keeping valve disposed in said inlet, the lowermost one of said telescopically extensible and retractable parts including a bottom plate, a spring-loaded nonreturn valve located in said bottom plate connecting the pressure space therebelow to the space above said lowermost one of said interengageable extensible and retractable parts, each of said parts having a cylindrical portion defining a pressure space which communicates through said nonreturn valve with the pressure medium, said nonreturn valve having a plunger rod valve actuating member projecting downwardly from said bottom plate and engageable upon movement of said bottom plate with said lowermost one of said parts to the bottom of said hydraulic ram to open said nonreturn valve.

7. A shield timbering frame, as claimed in claim 6, including a second bottom plate arranged at the end of said second one of said parts having a bore provided in an edge zone thereof and a central bore, a supporting pipe secured on the top side concentric to said central bore and having an upper end, a piston guided in said third one of said parts and being carried on the upper end of said pipe, said third part having a third bottom part with a central third bore therein, said supporting pipe being guided pressure-tight in said third central bore, the space between said piston and the third cylinder being connected with atmosphere.

* * * * *